US006508565B2

(12) United States Patent
Wang

(10) Patent No.: US 6,508,565 B2
(45) Date of Patent: Jan. 21, 2003

(54) RATCHET WRENCH WITH LIGHTING CIRCUIT MEANS

(76) Inventor: Peter Wang, No. 425, Hsihu Rd., Tali City, Taichung County (TW)

( * ) Notice: Subject to any disclaimer, the term of this patent is extended or adjusted under 35 U.S.C. 154(b) by 0 days.

(21) Appl. No.: 09/871,954

(22) Filed: Jun. 4, 2001

(65) Prior Publication Data

US 2002/0181228 A1 Dec. 5, 2002

(51) Int. Cl.[7] ..... B25B 23/18
(52) U.S. Cl. ..... 362/119; 362/120; 362/109
(58) Field of Search ..... 362/119, 120, 362/109

(56) References Cited

U.S. PATENT DOCUMENTS 5,826,968 A * 10/1998 Brantley et al. ..... 362/119
5,897,198 A * 4/1999 Hsieh ..... 362/119
6,290,366 B1 * 9/2001 Lin ..... 362/119

* cited by examiner

*Primary Examiner*—Sandra O'Shea
*Assistant Examiner*—Anabel Ton
(74) *Attorney, Agent, or Firm*—Rosenberg, Klein & Lee

(57) ABSTRACT

A ratchet wrench in which a lamp unit and a battery set are mounted inside the ratchet member, and a rotary cap-controlled switch assembly is coupled to one extension tube of the ratchet member and rotated forward/backwards on the extension tube to close/open the circuit of the lamp unit and the battery set.

4 Claims, 5 Drawing Sheets

RATCHET WRENCH WITH LIGHTING CIRCUIT MEANS

BACKGROUND OF THE INVENTION

The present invention relates to a ratchet wrench and, more particularly, to a ratchet wrench with lighting circuit means.

A variety of hand tools including screwdrivers, wrenches, pliers, and etc., have been disclosed for different purposes. When using a hand tool to grasp or turn a workpiece in a dark place, an external light source is needed. Screwdrivers with lighting circuit means are well known. However, wrench with lighting circuit means is not commercially available. It is inconvenient to operate a wrench with one hand and to hold a light with the other hand when working in the dark.

SUMMARY OF THE INVENTION

The present invention has been accomplished under the circumstances in view. It is one object of the present invention to provide a ratchet wrench with lighting circuit means, which comprises a lighting circuit assembly that can be conveniently set between the on position and the off position. It is another object of the present invention to provide a ratchet wrench with lighting circuit means, which comprises a lighting circuit assembly that can be removed from the wrench body without affecting the normal function of the ratchet wrench for grasping and turning nuts, bolts, etc. According to the present invention, the ratchet wrench comprises a metal wrench body, a metal ratchet member mounted in one end of the wrench body, the metal ratchet member comprising a workpiece coupling head at one side and an externally threaded extension tube at an opposite side, a battery set mounted within an electrically insulative sleeve inside the ratchet member, a lamp unit installed in the ratchet member and disposed in contact with the positive terminal of the battery set and holding a lamp bulb in a lamp hole in the workpiece coupling head, and a switch assembly threaded onto the externally threaded extension tube and rotated forwards/backwards to contact/not to contact the negative terminal of the battery set to further close/open the circuit of the lamp unit and the battery set.

BRIEF DESCRIPTION OF THE DRAWINGS

FIG. 3B is similar to FIG. 3A but showing the battery set disposed in contact with the metal spring of the lamp holder assembly, the lamp bulb turned on.

DETAILED DESCRIPTION OF THE PREFERRED EMBODIMENT

Figure 1:
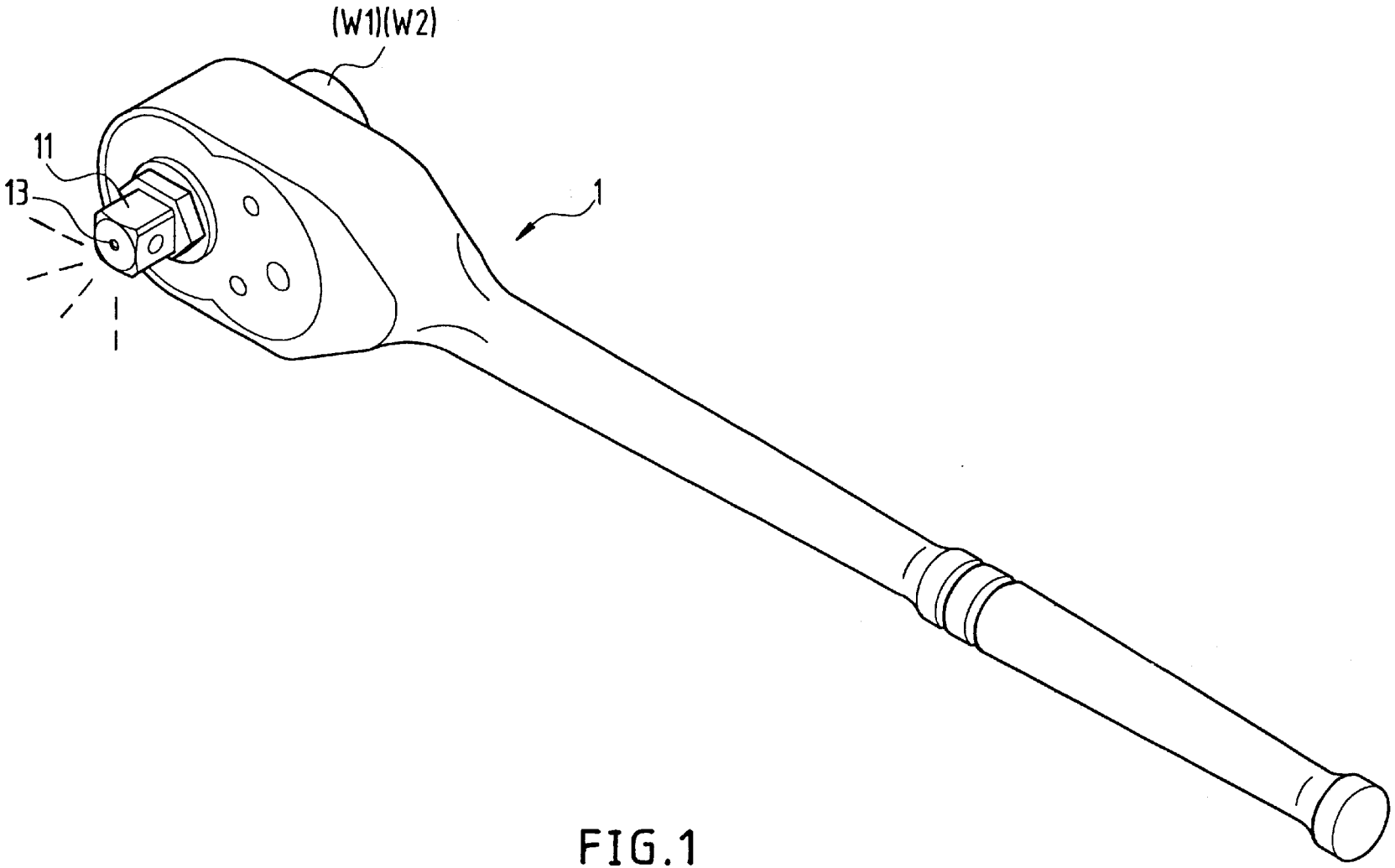
FIG. 1 is an elevational view of a ratchet wrench with lighting circuit means according to a first embodiment of the present invention.
Figure 2:
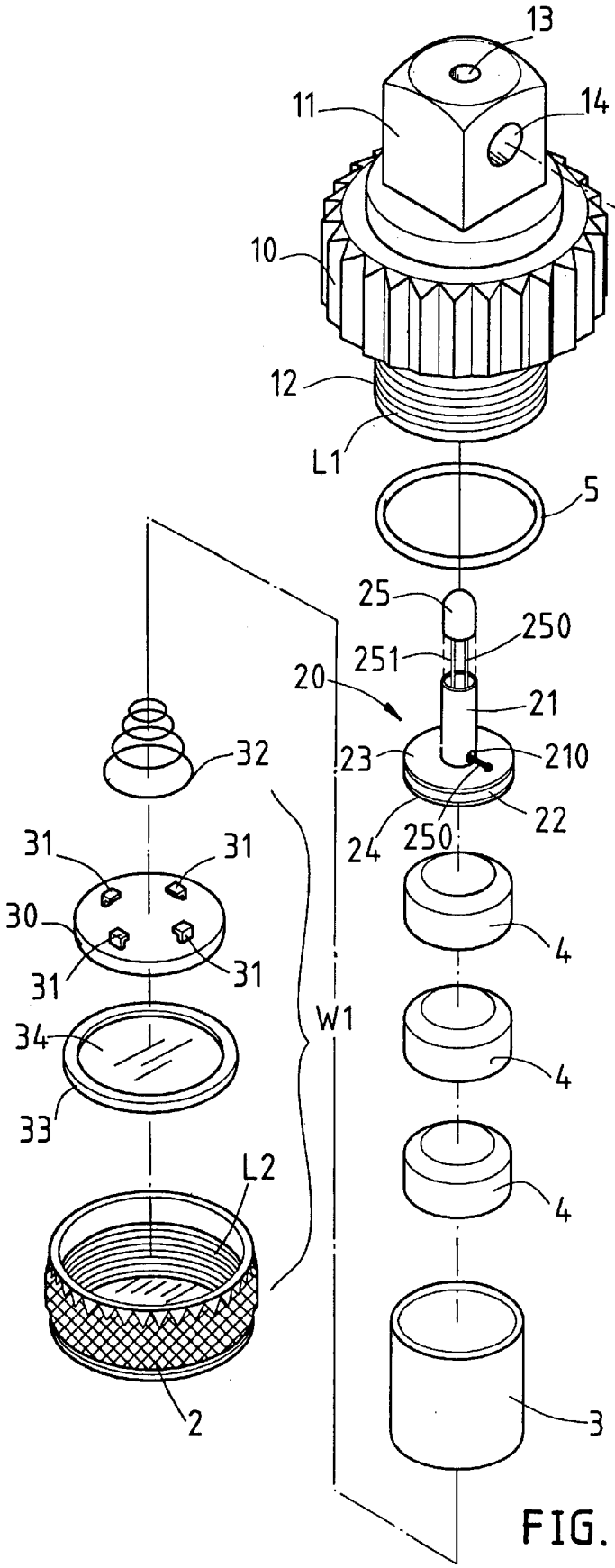
FIG. 2 is an exploded view in section of the first embodiment of the present invention.
Figure 2A:
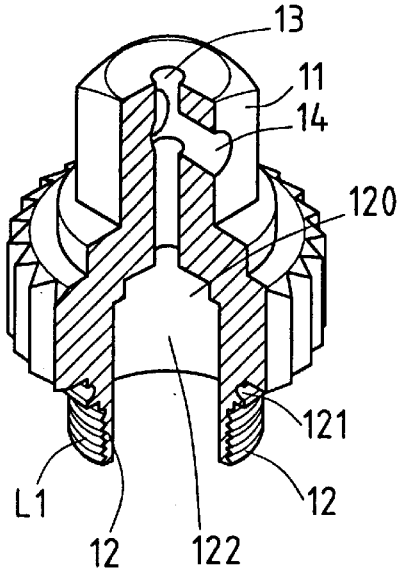
FIG. 2A is a sectional elevation of the ratchet member shown in FIG. 2.

Referring to FIGS. from 1 through 3, a ratchet wrench with lighting circuit means constructed according to a first embodiment of the invention is shown comprised of a metal wrench body 1, a metal ratchet member 10 mounted in one end of the wrench body 1, a lamp unit 20, a switch assembly W1, and a battery set 4. The ratchet member 10 has an integrated workpiece coupling head 11. The workpiece coupling head 11 comprises a transversely extended peripheral hole 14, a spring 15 mounted in the peripheral hole 14, and a steel ball 17 supported on the spring 15 and partially forced out of the peripheral hole 14 by the spring 15 for holding down the workpiece.

Referring to FIGS. from 1 through 3 again, the metal ratchet member 10 is a hollow member comprising a metal extension tube 12 disposed at one side opposite to and in line with the workpiece coupling head 11, an outer thread L1 extended around the periphery of the extension tube 12, an outside annular groove 121 around the periphery of the extension tube 12, a bottom open chamber 122 defined within the extension tube 12, a lamp hole 13 axially extended through the center of the workpiece coupling head 11, and an inside chamber 120 disposed in communication between the bottom open chamber 122 and the lamp hole 13. An electrically insulative sleeve 3 is mounted within the bottom open chamber 122 to hold the battery set 4 inside the ratchet member 10. The lamp unit 20 is mounted in the inside chamber 120 and lamp hole 13 of the ratchet member 10 and stopped against one terminal, namely, the positive terminal of the battery set 4.

The switch assembly W1 comprises a rotary cap 2, the rotary cap 2 having an inner thread L2 threaded onto the outer thread L1 of the extension tube 12 of the ratchet member 10, an electrically insulative gasket 33 mounted inside the rotary cap 2, the gasket 33 having a recessed receiving portion 34 at its one side, an electrically conductive disk 30 fitted into the recessed receiving portion 34 of the gasket 33, the electrically conductive disk 30 comprising a plurality of L-shaped locating rods 31 protruded from one side thereof, and a metal conical spring 32 fastened to the L-shaped locating rods 31 and supported on the electrically conductive disk 30. Rotating the rotary cap 2 forwards/backwards causes the metal conical spring 32 to touch/not to touch one terminal, namely, the negative terminal of the battery set 4 and the electrically conductive disk 30 to touch/not to touch the extension tube 12 of the ratchet member 10, so as to turn on/off the lamp unit 20.

The lamp unit 20 comprises an electrically insulative holder base 22, an electrically insulative tube 21 perpendicularly extended from one side of the electrically insulative holder base 22, a through hole 210 transversely extended through the electrically insulative tube 21 adjacent to the electrically insulative holder base 22, a lamp bulb 25 mounted in the end of the electrically insulative tube 21 remote from the electrically insulative holder base 22, the lamp bulb 25 having a first lead-out wire 250 extended out of the electrically insulative tube 21 through the through hole 210 and a second lead-out wire 251 extended through the electrically insulative holder base 22, a first metal contact plate 23 covered on the top side of the electrically insulative holder base 22 around the electrically insulative tube 21 and connected to the first lead-out wire 250 of the lamp bulb 25 and disposed in contact with the metal ratchet member 10, and a second metal contact plate 24 covered on the bottom side of the electrically insulative holder base 22 and connected to the second lead-out wire 251 of the lamp bulb 25 and disposed in contact with the positive terminal of the battery set 4.

The transversely extended peripheral hole 14 of the workpiece coupling head 11 extends across the lamp hole 13. The spring 15 has a curved portion 16 closely attached to the peripheral wall of the transversely extended peripheral hole 14 of the workpiece coupling head 111 such that the positioning of the electrically insulative tube 21 with the lamp bulb 25 in the lamp hole 13 does not hinder the compression and expanding effect of the spring 15.

Further, a rubber ring 5 is mounted in the annular groove 121 around the extension tube 12. When rotating the rotary cap 2 forwards to turn on the lamp bulb 25, the rotary cap 2 is stopped against the rubber ring 5.

As indicated above, the installation of the lamp unit 20 and the battery set 4 with the electrically insulative sleeve 3 and the switch assembly W1 neither hinders normal operation of the ratchet wrench to grasp and turn nuts, bolts, etc., nor increases the dimension of the ratchet wrench. After removable of the lamp unit 20 and the electrically insulative sleeve 3 and the battery set 4 from the ratchet member 10, the ratchet wrench still functions well as a normal wrench.

Figure 3A:
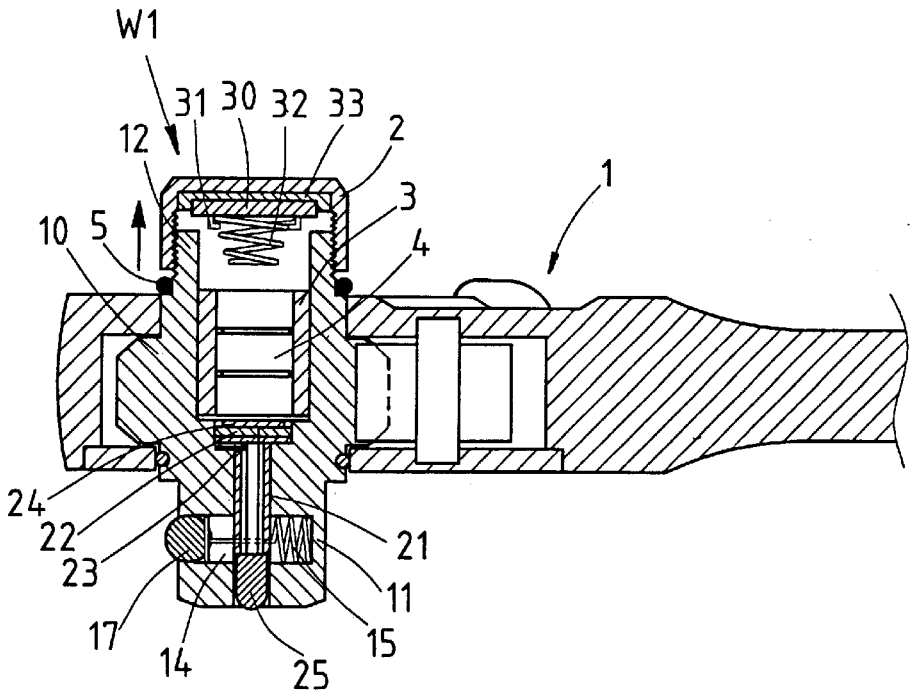
FIG. 3A is a sectional assembly view of the first embodiment of the present invention, showing the battery set disconnected from the lamp holder assembly.
Figure 3B:
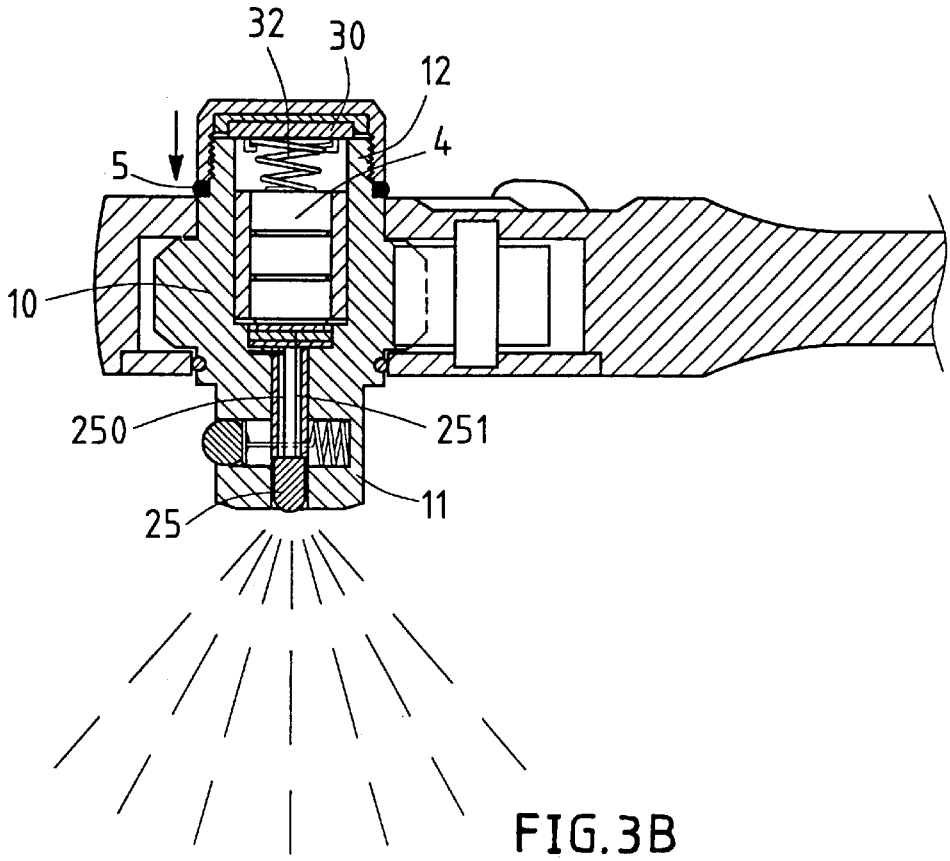

Referring to FIGS. 3A and 3B again, when assembled, the rotary cap 2 is rotated backwards/forwards on the extension tube 12 of the ratchet member 10 between the off position shown in FIG. 3A where the metal conical spring 32 and the electrically conductive disk 30 are respectively moved away from the battery set 4 and the metal ratchet member 10 to open the circuit and therefore the lamp bulb 25 is off, and the on position shown in FIG. 3B where the metal conical spring 32 and the electrically conductive disk 30 are respectively forced into contact with the negative terminal of the battery set 4 and the metal ratchet member 10 to close the circuit and therefore the lamp bulb 25 is on.

Figures 4, 4A:
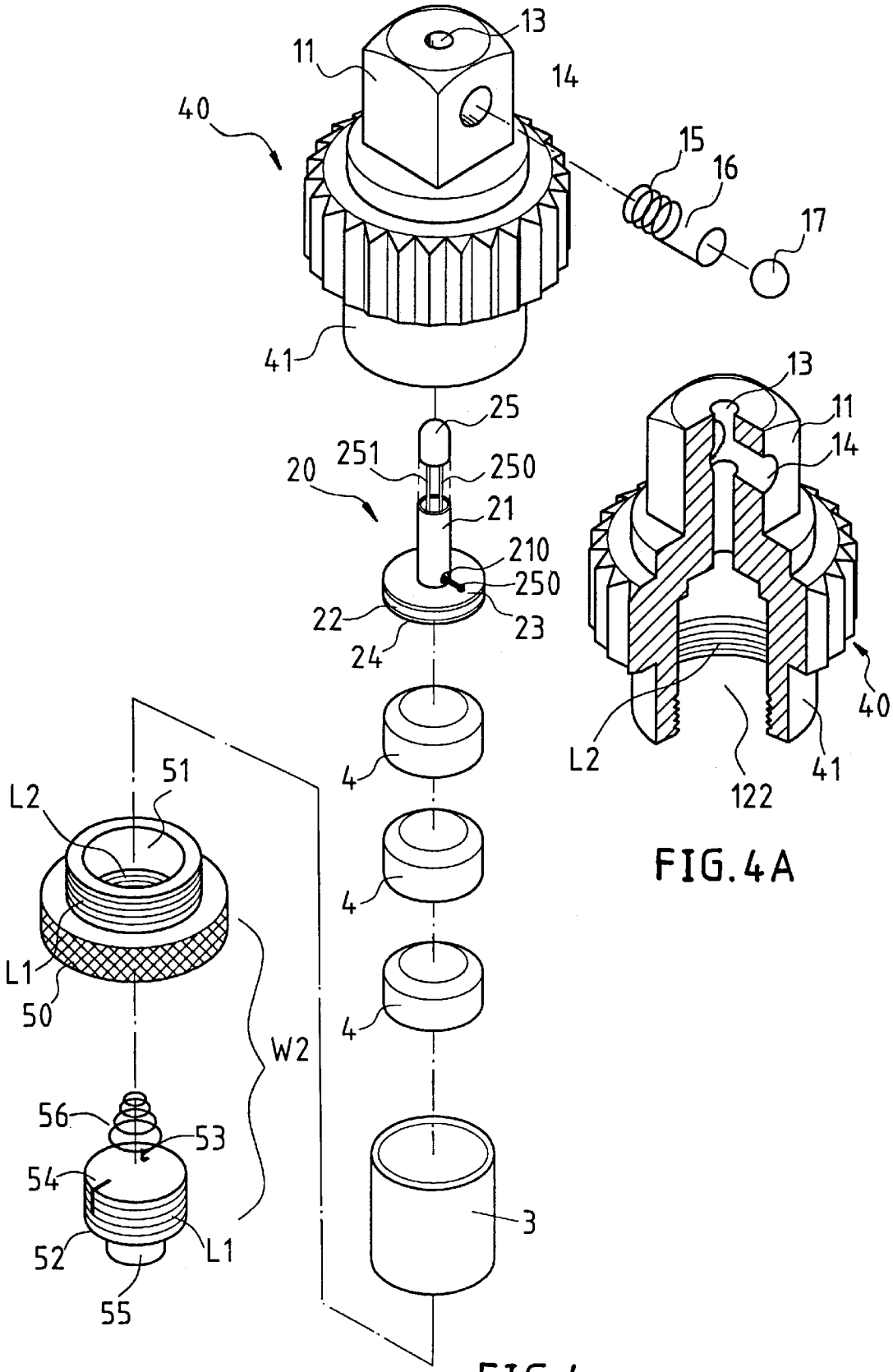
FIG. 4 is an exploded view of a second embodiment of the present invention.
FIG. 4A is a sectional elevation of the ratchet member shown in FIG. 4.
Figure 5:
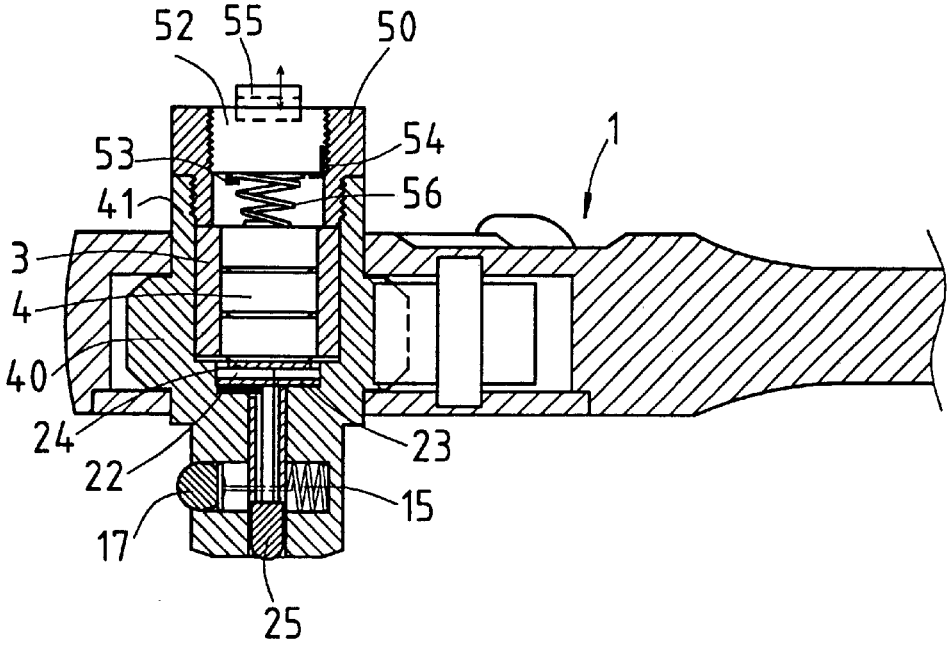
FIG. 5 is a sectional assembly view of the second embodiment of the present invention.

FIGS. 4 and 5 show an alternate form of the present invention. According to this alternate form, the switch assembly W2 is coupled to an inner thread L2 in the bottom open chamber 122 of the extension tube 41 of the metal ratchet member 40. The switch assembly W2 is comprised of a power switch 52, a metal conical spring 56, and a metal screw cap 50. The screw cap 50 comprises an outer thread L1 threaded into the inner thread L2 of the ratchet member 40, a circular receiving hole 51, and an inner thread L2 in the circular receiving hole 51. The power switch 52 comprises an outer thread L1 threaded into the inner thread L2 of the screw cap 50, a first metal contact 53, a second metal contact 54 disposed in contact with the metal screw cap 50, and a button 55. The metal conical spring 56 is connected to the first metal contact 53 and disposed in contact with the negative terminal of the battery set 4. The button 55 is controlled to close/open the circuit between the first metal contact 53 and the second metal contact 54.

A prototype of ratchet wrench with lighting circuit means has been constructed with the features of FIGS. 1~5. The ratchet wrench with lighting circuit means functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A ratchet wrench, comprising:

a wrench body, said wrench body having first and second opposed ends;

a hollow ratchet member being mounted on said first end of said wrench body and having a workpiece coupling head projecting orthogonally from an upper surface thereof, a lamp hole axially extending through a central region of said workpiece coupling head, said workpiece coupling head having a transversely extended peripheral hole formed therethrough, said peripheral hole receiving a spring;

an externally threaded metal extension tube extending from a lower surface of said hollow ratchet member, a bottom open chamber being defined within said externally threaded metal extension tube, said bottom open chamber communicating with said lamp hole through an inner chamber;

an electrically insulative sleeve positioned within said bottom open chamber;

a set of batteries received within said electrically insulative sleeve;

a steel ball mounted on said spring in said peripheral hole and partially projecting therefrom for retaining a workpiece to said workpiece coupling head;

a lamp unit mounted within said inner chamber of said lamp hole of said hollow ratchet member and contacting an upper terminal of said set of batteries; and, a switch assembly received by said hollow ratchet member to selectively actuate said lamp unit, said switch assembly having a rotary cap, said rotary cap having an inner threaded surface for engaging said externally threaded metal extension tube of said hollow ratchet member, an electrically insulative gasket being received by said rotary cap, said gasket having a recessed receiving portion formed on an upper surface thereof, said recessed receiving portion receiving and securing an electrically conductive disc, said electrically conductive disc having a plurality of L-shaped locating rods protruding from one side thereof, said L-shaped locating rods receiving and securing a metal conical spring, whereby selective rotation of said rotary cap causes an upper end of said metal conical spring to selectively contact a lower terminal of said set of batteries, which allows for selective actuation of said lamp unit.

2. The ratchet wrench as recited in claim 1, wherein said lamp unit contains an electrically insulative holder base, said electrically insulative holder base having an electrically insulative tube projecting orthogonally from a first side thereof, said electrically insulative tube having a lamp bulb mounted therein and having a transversely extended through hole formed therethrough, said lamp bulb having first and second lead wires, said first lead wire extending from said electrically insulative tube through said through hole and being connected to a first metal contact plate, said first metal contact plate being formed on an upper side of said electrically insulative holder base, said first metal contact plate contacting said hollow ratchet member, said second lead wire extending through said electrically insulative holder base and being connected to a second metal contact plate, said second metal contact plate being mounted on a lower side of said electrically insulative holder base, said second metal contact plate contacting said upper terminal of said set of batteries.

3. The ratchet wrench as recited in claim 1, wherein said transversely extended peripheral hole of said workpiece coupling head extends across said lamp hole, said spring being received in said transversely extended peripheral hole of said workpiece coupling head and having a curved portion extending along a peripheral wall of said transversely extended peripheral hole of said workpiece coupling head.

4. The ratchet wrench as recited in claim 1, wherein said hollow ratchet member has an outer annular groove extended around a periphery of said externally threaded extension tube, a rubber ring being mounted in said outer annular groove and being adapted to limit forward movement of said rotary cap on said externally threaded extension tube.

* * * * *